US009789527B2

(12) United States Patent
Keller

(10) Patent No.: US 9,789,527 B2
(45) Date of Patent: Oct. 17, 2017

(54) TUBE BENDING TOOL

(71) Applicant: Janos Keller, Oskarshamn (SE)

(72) Inventor: Janos Keller, Oskarshamn (SE)

( * ) Notice: Subject to any disclaimer, the term of this patent is extended or adjusted under 35 U.S.C. 154(b) by 0 days.

(21) Appl. No.: 15/119,623

(22) PCT Filed: Feb. 12, 2015

(86) PCT No.: PCT/SE2015/000007

§ 371 (c)(1),
(2) Date: Aug. 17, 2016

(87) PCT Pub. No.: WO2015/122823

PCT Pub. Date: Aug. 20, 2015

(65) Prior Publication Data

US 2017/0066026 A1 Mar. 9, 2017

(30) Foreign Application Priority Data

Feb. 17, 2014 (SE) ..... 1400089

(51) Int. Cl.
*B21D 7/04* (2006.01)
*B21D 7/06* (2006.01)
*B21D 7/02* (2006.01)

(52) U.S. Cl.
CPC ..... *B21D 7/063* (2013.01); *B21D 7/02* (2013.01); *B21D 7/04* (2013.01)

(58) Field of Classification Search
CPC ..... B21D 7/02; B21D 7/063; B21D 7/04
USPC ..... 72/389.1
See application file for complete search history.

(56) References Cited

U.S. PATENT DOCUMENTS

| | | | | |
|---|---|---|---|---|
| 1,964,550 A | | 6/1934 | Abramson et al. | |
| 2,405,931 A | | 8/1946 | Abramson et al. | |
| 2,938,564 A | | 5/1960 | Rhodes | |
| 3,869,917 A | * | 3/1975 | Lapp | B21D 7/06 72/304 |
| 4,005,593 A | | 2/1977 | Goldberg | |
| 5,615,572 A | | 4/1997 | Johnson et al. | |

FOREIGN PATENT DOCUMENTS

| | | |
|---|---|---|
| GB | 700422 A | 12/1953 |
| GB | 1 502 572 A | 3/1978 |

* cited by examiner

*Primary Examiner* — David B Jones
(74) *Attorney, Agent, or Firm* — Blank Rome LLP

(57) ABSTRACT

A tube bending tool (1) comprising support surfaces (2, 2', 2"), between said surfaces a tube (3), to be bent, is placed. A pressure exerting unit (6) with an extension (8) displaceable towards the tube (3), where a convex, bent bearing surface (10) is provided in order to press against the tube (3) when said extension (8) delivers a force from the pressure exerting unit (6). The front portion (9) comprises elongated elements (12, 12'). The outer ends of the elongated elements (12, 12') comprise displaceable and movable support elements which press on the outer surface of the tube. The inner ends (13, 13') of the elongated elements are cross-laid and movable, so that they during bending, press in a direction towards the center of the bending radius of the tube (3), at the same time as different radii of the bend (5) can be provided on different places. There is also an optional limiting means for bends over 90 degrees.

3 Claims, 1 Drawing Sheet

TUBE BENDING TOOL

The present invention refers to a tool intended to be used for bending tubes when a user bends the tube in situ where the tube shall be mounted and where it can be seen where it shall be bent, how much and by which radius.

On the marked existing structures of this type are today using big tube bending machines, which are placed on working tables. The tubes must in this case after that one has taken necessary measures on the actual mounting place be bent according to those. Then it can be necessary with several rounds with the tube in hand away to that place, where it shall be mounted and back to the not movable tube bending machine on the working table in order to be bent. These rounds must be taken also for small adjustments of the tube, when the same only nearly suits to previous many rounds. It takes a long time and it also happens that it will be a lot of wrong curvatures, which makes that the tube must be thrown away or can start to leak after some time. This costs much money.

One object of the present invention is to eliminate these drawbacks, which exist when using the not movable tube bending machines mentioned above.

Thanks to the invention a device has been provided for a tube bending machine, which in an excellent way fulfills its purpose in that the bending of the tubes can be done very quickly at the same time as it can be done both exactly and securely.

Figure 1:
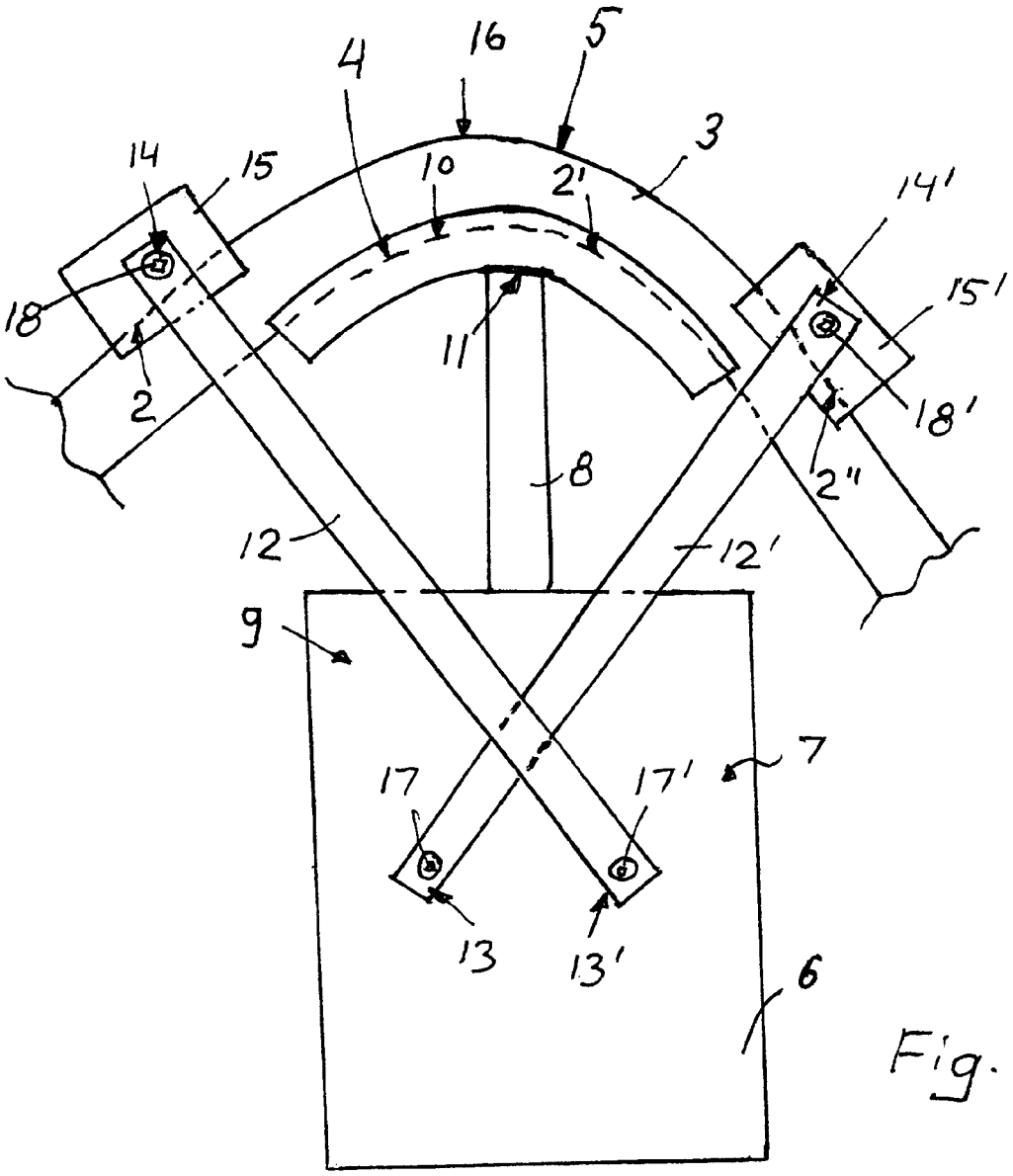
Figure 2:
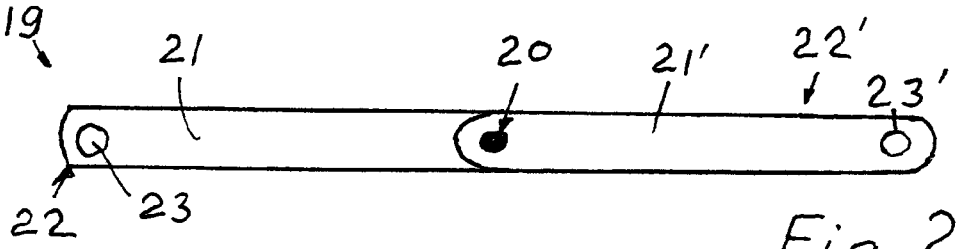

The invention will be described closer below by aid of a preferred embodiment example with reference to the drawings enclosed, in which FIG. 1 shows a schematic view from above of a tube bending tool according to the present invention, and FIG. 2 shows a distance limiting means, which is used in those cases one shall bend tubes in an angle over about 90°.

As can be seen from FIG. 1 here is illustrated a tube bending tool 1, which comprises support surfaces 2,2',2" between which a tube 3 can be placed for bending and providing of a bend 5. The tube bending tool 1 comprises preliminary a pressure exerting unit 6, which is provided with an extension 8, which can be pressed outwards from the same and which is provided in the front portion 9 of the pressure exerting unit 6, which is directed towards the tube 3, where a convexly bent bearing surface 10 is provided in the end 11 of the extension and which by aid of a supplied force from the pressure exerting unit 6 via in a direction forwards movable extension 8 presses against a mantle surface 4 of the tube 3. The front portion 9 of the pressure exerting unit 6 comprises on at least one side of the tool 1 two elongated elements 12,12' the first ends 13,13' of which are movably provided around bolts 17,17' in the pressure exerting unit 6 and the other ends 14,14' of which have support elements 15,15' displaceable along the mantle surface 4 of the tube 3. In said elements 15,15' the ends 14,14' are provided movable around bolts 18,18'. The support elements 15,15' are situated on each side of the bearing surface 10 before the bending starts in order to press the supplied force in a direction towards the opposite mantle surface 16 of the tube 3. When the bearing surface 10 is pressed more and more forwards to the mantle surface 4 the tube 3 is bent in a desired extent against the support elements 15,15', so that the bend 5 of the tube 3 reaches a bending angle up to at least 90°. In the support elements 15,15' loose laid-in elements, not illustrated in the drawings, can be used, so that different tube dimensions are bendable without that the support elements 15,15' must be changed between different tube dimensions. These laid-in elements can consist of different materials for example bronze, steel or plastic depending on which materials the tube being bent consists of in order to reach the best bending result. The pressure exerting unit 6 comprises a pneumatic guided cylinder 7 containing oil or gas. The elongated elements 12,12' are cross-laid in order to press during the bending in a direction, which is directed mainly towards the centrum of the bending radius of the tube 3, so that different radius of the bending over desired or determined places can be achieved also in situ, where the tube shall be mounted. The bending can alternatively also be done on an already in situ mounted tube 3, since no forces arise of the tube 3 outside the pressure exerting unit 6.

When a tube shall be bent more than about 90° a detachable distance limiting means 19 consisting of two, via a central bolt 20, relatively each other, in a side direction movable link arms 21,21', the free ends 22,22' of which having holes 23 and 23', which each are connectable with the support element 15 and 15' in cooperation with cylinder formed bolt heads 24,24', which fit into the holes 23,23' and are formed on the bolts 18,18' of the support elements 15,15'. During bending when the extension 8 from the beginning is pressed outwards by the pneumatically guided cylinder 7 of the pressure exerting unit 6 the support elements 15,15' are first close to each other having the distance limiting means 19 in an angularly together state in a direction towards the pressure exerting unit 6, so that after that, during the movement of the extension 8 in a direction outwards, continue into a straight condition between the support elements 15,15', whereupon during a bending more than 90° of the tube 3, the straight distance limiting means 19 now retains the two support elements 15,15' in a constant distance from each other, so that much bigger bends than 90° degrees can be done.

The invention claimed is:

1. A tool for bending a tube, comprising:

a convex bearing surface, and displaceable and moveable support elements on each side of the bearing surface, the bearing surface and the support elements being configured to support the tube therebetween with the tube placed on the bearing surface, and portions of a mantle surface of the tube bearing on and pressing the bearing surface;

a pressure exerting unit including at least one extension displaceable toward the bearing surface, the extension having an end for pressing against the bearing surface to apply a force from the pressure exerting unit;

first elongated elements having first ends and second ends, the first ends being opposite the second ends, the first ends being movably connected to the pressure exerting unit, the second ends being movably connected to the support elements, the first elongated elements being configured to apply forces to an opposite surface of the tube when the bearing surface presses against the mantle surface of the tube, such that the tube is bent between and against the support elements, and wherein the first elongated elements cross each other near the first ends, such that the first ends are spaced apart from each other, and such that, during bending of the tube, the first elongated elements pull in. directions directed mainly toward a center of a bending radius of the tube at the same time as the tube is provided with different bend radii at selected places; and a distance limiting device which has second elongated elements each with first and second ends, and wherein the second ends of the second elongated elements are detachably connected to the support elements, the first ends of the second elongated elements are rotatably connected, and the tool is configured such that, when the tube is bent more than about 90°, the second elongated elements become aligned with each other to prevent the distance between the support elements from being greater than the combined length of the aligned second elongated elements.

2. A tube bending tool according to claim 1, wherein the pressure exerting unit includes a pneumatically/hydraulically controlled cylinder containing oil or gas.

3. A tube bending tool according to claim 1, wherein the support elements include bolts, the second elongated elements are connected to each other by a central bolt, and the second ends of the second elongated elements include holes for receiving the bolts of the support elements.

* * * * *